US005402704A

United States Patent [19]

Donovan

[11] Patent Number: 5,402,704

[45] Date of Patent: Apr. 4, 1995

[54] ARMOR FOR DEFEATING KINETIC ENERGY PROJECTILES

[76] Inventor: William F. Donovan, 3513 Farm Rd., Aberdeen, Md. 21001

[21] Appl. No.: 154,501

[22] Filed: Nov. 19, 1993

Related U.S. Application Data

[63] Continuation-in-part of Ser. No. 764,727, Sep. 24, 1991, abandoned.

[51] Int. Cl.[6] ..... F41H 5/013; F41H 5/04; F41H 5/18

[52] U.S. Cl. ..... 89/36.03; 89/36.08; 89/36.02

[58] Field of Search ..... 89/36.03, 36.02, 36.01, 89/36.04, 36.08, 36.11, 36.12, 36.13

[56] References Cited

U.S. PATENT DOCUMENTS

| | | | |
|---|---|---|---|
| 985,640 | 2/1911 | Stewart | 89/36.02 |
| 1,236,033 | 8/1917 | Almengual | 89/36.02 |
| 2,200,230 | 5/1940 | Hojnowski | 89/36.08 |
| 2,283,484 | 5/1942 | Bak | 89/36.02 |
| 4,404,889 | 9/1983 | Miguel | 89/36.02 |
| 4,731,507 | 3/1988 | Tovimoto et al. | 89/36.02 |

FOREIGN PATENT DOCUMENTS

| | | | |
|---|---|---|---|
| 2547908 | 12/1984 | France | 89/36.02 |
| 682180 | 10/1939 | Germany | 89/36.02 |
| 1127759 | 4/1962 | Germany | 89/36.02 |
| 2409876 | 9/1975 | Germany | 89/36.08 |
| 2556722 | 7/1988 | Germany | 89/36.02 |
| 535638 | 4/1941 | United Kingdom | 89/36.02 |

*Primary Examiner*—Stephen M. Johnson
*Attorney, Agent, or Firm*—Walter G. Finch

[57] ABSTRACT

An improvement to existing embedded armor found in tank systems that seeks to degrade the performance of kinetic energy projectiles, traveling at speeds ranging from high to supersonic is provided. Improvements are achieved by employing a mechanical means to hold the individual plates of an armor system in standby position while allowing them to pivot about a fixed axis of rotation when contacted by an incoming projectile. A kinetic energy projectile fired at a tank usually begins penetration of primary defenses by cutting through a tipping screen and then the tank hull. When the projectile reaches and begins penetration of the embedded armor arrangement, it rotates the lead armor plate about its pivot axis and thereby travels through and out of the armor plate on an altered trajectory. The dimished and dampened projectile will encounter further deviation from its original trajectory, deterioration in size, and reduction of momentum as it reaches other spaced pivoting plates having a sequential pattern of vertically offset axes of rotation. These features ultimately add to the safety and security of personnel and stored ammunition within the tank.

11 Claims, 9 Drawing Sheets

FIG. 11
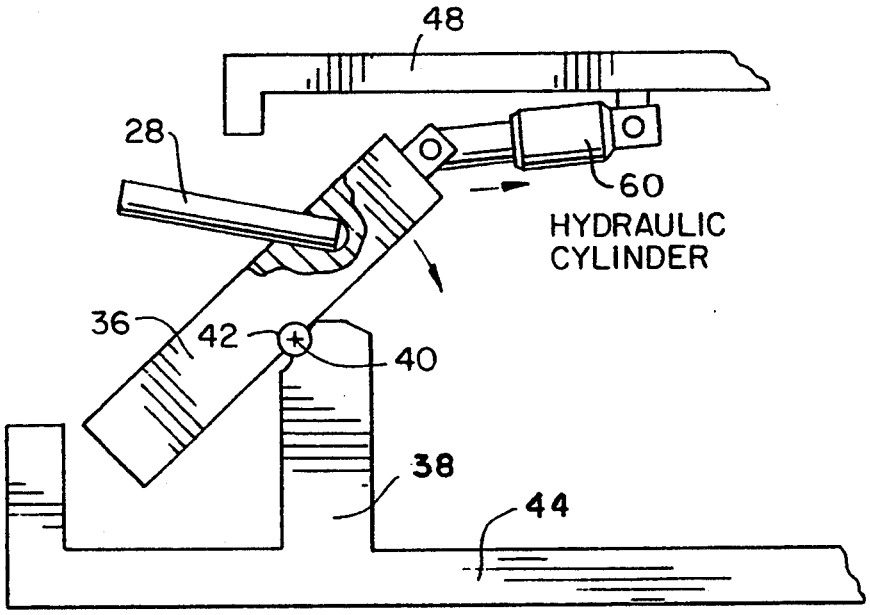
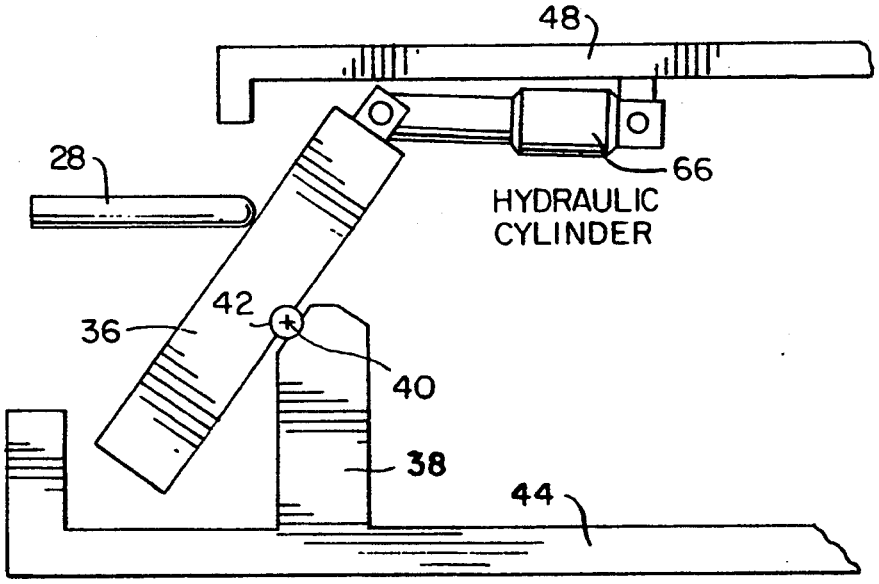
FIG. 10

ARMOR FOR DEFEATING KINETIC ENERGY PROJECTILES

This application is a continuation-in-part of U.S. patent application Ser. No. 07/764,727, filed Sep. 24, 1991, now abandoned.

BACKGROUND OF THE INVENTION

This invention relates to improvements in battle armor, and more particularly it pertains to improvements in the battle armor of a tank, therein providing increased security against kinetic energy projectiles used in combat situations.

BEST KNOWN PRIOR ART

The best known prior U.S. art is as follows: U.S. Pat. Nos.
2,200,230
2,625,859
4,355,562
4,545,286
4,738,184
4,833,968
4,998,994

The concept of protecting ammunition and, more importantly, combat personnel in ships, trucks, jeeps, tanks and armored vehicles is not only well known in the art, but it has been an intricate part of military conflicts over the past century. This invention seeks to provide personnel as well as ammunition, within a battle tank and other types of combat vehicles, with greater security by making improvements in the tank armor which will prove effective in defeating the frequently used anti-tank kinetic energy projectiles.

Prior to direct U.S. involvement in World War II, the U.S. Pat. No. 2,200,230, issued to Hojnowski, introduced a new design for an armored motor car or tank. In the design, laterally disposed shields or guard walls hinge-connected at their ends to the side walls of the tank were, when operatively disposed, positioned in transversely extending directions in such a manner that soldiers could march behind them while being protected from enemy fire.

World War II soon passed, and with it, the discovery that tanks were most vulnerable in their undercarriage, including the wheels, suspension means, and tread of the caterpillar.

Dandini, in U.S. Pat. No. 2,625,859, proposed a skirt design for the protection of a tank's undercarriage. The skirt consisted of two rows of cylindrical bodies suspended along the outer rim of the undercarriage which cooperated with each other to first absorb the impact of and finally stop incoming projectiles.

Today's anti-tank missiles are of three basic varieties. The first is an armor piercing kinetic energy round known as a kinetic penetrator. This very narrow, elongate, and dense projectile is propelled at extremely high velocities by means of a gas explosion and, though absent an explosive charge, accomplishes destruction by first piercing through a tank's armor and then ricocheting off of the interior walls, subsequently killing personnel and destroying stored ammunition.

The second type of missile is known as a shaped charge. This type of projectile detonates upon impact with a tank, thus producing a high energy heat explosion which melts existing armor and incinerates personnel inside.

The third type of anti-tank projectile is known as the HESH charge (an acronym for High Explosive Squish Head). This highly explosive projectile spreads a layer of explosive charge over an area of the tank and then detonates. Though it does not penetrate the armor, it sends a shock wave through the tank which causes inner armor and walls to collapse inwardly, thereby killing personnel and setting off and/or detonating the ammunition in the vehicle.

This invention seeks improvements to armor which will help defeat the first type of anti-tank projectile known as the kinetic round. An improvement to this type of projectile is the subject of the Schmidt, et al U.S. Pat. No. 4,998,994, which deals with the reduction of the upsetting moment caused by a displacing force during the flight of a supersonic projectile of the fin or flare type.

Briefly, the physics behind the interaction of armor and an incoming kinetic projectile must be such that the armor absorbs the mechanical and thermochemical energy of the attacking missile in order that the tank system survives. This usually means that the kinetic projectile is expended by erosion and melting as it passes through the embedded armor until it progressively slows down in velocity and is stopped.

Improvements to the substance of armor is the subject of the Sewell, et al U.S. Pat. No. 4,355,562 which teaches how a projectile's kinetic force is diminished by the consumption of kinetic energy required to traverse an armor plate. This is achieved through the use of Travertine, a new and lightweight armor. The Travertine has a Poission's Ration as low as 0.009–0.010 along the axial direction and always deflects a projectile's energy in an orientation perpendicular relative to the lines of striation found in the material.

Situation and geometric arrangement of armor in and around a tank is critical. An anti-tank projectile which has been fired on a target would have a trajectory that would take it through the primary defenses of a tank usually starting with the piercing of a tipping screen, designed to slightly alter the trajectory of an incoming missile. The projectile would then readily pass through the tank hull and into the interior embedded armor. The frontal embedded armor usually consists of a multi-element arrangement with air space between several inclined and rigidly fixed plates designed to slow down and trap an incoming projectile. The side, top, and bottom embedded armor include variations of the frontal armor, but to a lesser degree of complexity.

In the U.S. Pat. No. 4,738,184 as well as U.S. Pat. No. 4,833,968, Bohne, et al discuss a system comprising a plurality of square sections not attached to each other, but when individually mounted by means of one elastic and pivotable engaging or disengaging member and at least one other elastic housing member, collectively form an effective outer armor plate which can withstand impact energies of about 600 m to, dissipating such energies in shortest exposure time to a residual energy of about 40 m to. This applies for impact angles between thirty and ninety degrees.

The Fedj U.S. Pat. No. 4,545,286 teaches the use of active armor plating for tanks with features designed to protect against each of the three types of anti-tank missiles previously discussed. The armor plating consists of individual tiles centrally bolted to crucial areas over the tank. The tiles consist of a soft outer layer, a steel middle layer, and a heat dissipating ceramic rear layer.

Kinetic projectiles become embedded in the soft outer layer but break the tile off and spin away before they can penetrate the steel layer. Shaped charges pierce the soft plate and the steel plate, but dissipate over the entire surface of the ceramic plate, thereby leaving the tank armor intact. HESH charges spread over a few plates and explode, but the space provided between the plates and the tank armor keeps the shockwave from causing destructive inner fracture and explosion within the tank.

This invention seeks to improve the embedded armor of a tank used to defeat kinetic rounds since no such type of armor substance of arrangement thereof has proven to be completely effective and reliable in guarding against the assault.

OBJECTS OF THE INVENTION

It is an object of this invention to provide improvements to the embedded armor of a tank system.

Still another object of this invention is to provide unique and novel improvements to the embedded armor of a tank system which require only an alteration of existing embedded armor, which necessitates only a basic mechanical apparatus, which may be readily incorporated into existing systems, and which is more reliable than present armor systems in guarding against kinetic energy projectiles fired in combat operations.

To upgrade the embedded armor on a tank by incorporating a pivot action on armor plates, wherein the destructive capability of kinetic projectiles will be weakened from changes in trajectory resulting from the pivoting action of sequential armor plates are other objects of this invention.

A further object of the invention is to provide an embedded tank armor whereby the sequential armor plates will have vertically offset pivoting axes.

To provide improvements to the embedded armor system of an armored vehicle wherein armor plates are mounted flexibly on a transverse axle which is rigidly attached to the hull of the armored vehicle is another object of this invention.

To provide an improved embedded armor arrangement in an armored vehicle wherein pivoting armor plates are ultimately restrained from translation by attachment to the hull structure of the armored vehicle is another object of this invention.

To provide upgrading to the embedded armor of an armored vehicle wherein flexible mounting is accomplished by articulating links forming chains attached to the hull structure that suspend the armor plates and allow them to translate upwards when acted on by an outside force is another object of this invention.

Another object is to ameliorate the embedded armor of an armored vehicle wherein armor plates are fixed on stationary transverse axles and are restrained at their extremities by a mechanical coil action or by mechanical springs, and wherein restraint may also be achieved solely by the action of hydraulic cylinders at the extremities of the plates.

BRIEF DESCRIPTION OF THE DRAWINGS

These and other attendant advantages of this invention will become more obvious and apparent from the following detailed specification and accompanying drawings in which:

FIG. 10 is a front view of the individual plate of the embedded armor of the armored vehicle of FIG. 1 incorporating a hydraulic cylinder at its upper extremity and being initially engaged by a kinetic energy projectile;

FIG. 11 is a partial section view of the individual plate of the embedded armor of the armored vehicle of FIG. 1 and depicted in FIG. 10 where the kinetic energy projectile has both entered and pivoted the plate;

DESCRIPTION OF THE PREFERRED EMBODIMENTS OF THE INVENTION

Referring now to FIGS. 1 to 17 of the drawings, there is shown the preferred embodiment of improvements to the embedded armor 12 of an armored vehicle 10, such improvements ready to facilitate the abatement of the destructive capability of a kinetic energy missile 28.

Figure 1:
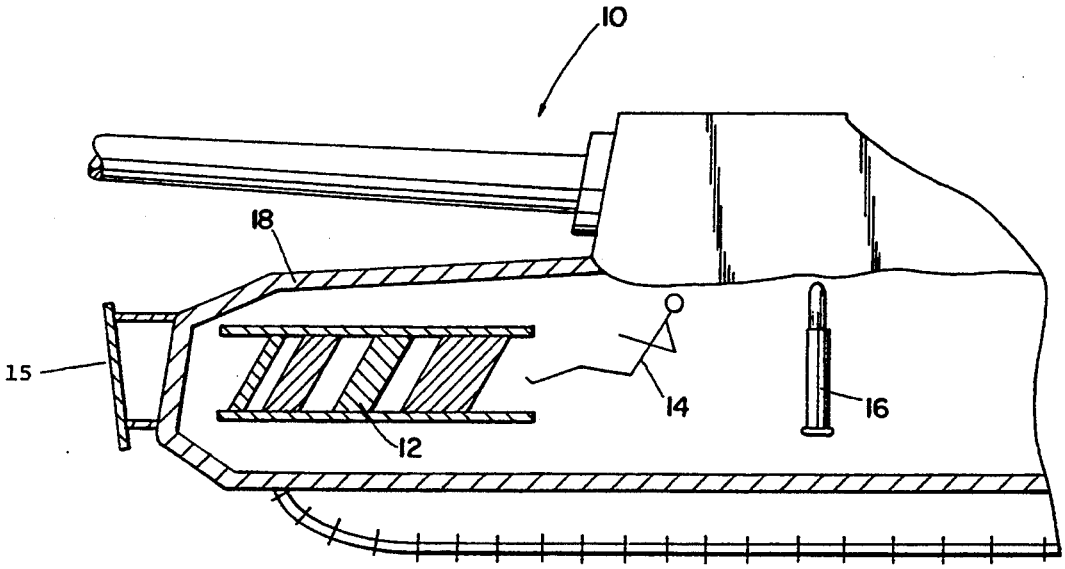
FIG. 1 is a section view of a simulated armored vehicle.

The armored vehicle 10 of FIG. 1 comprises a tipping screen 15, a tank hull 18, a conventional embedded armor arrangement 12, and stored ammunition 16. The tank hull 18 is a hard, metal outer shell which provides the armored vehicle 10 with a rigid base frame. All armored vehicle 10 components are either directly or indirectly fixed to this rigid tank hull 18.

Figure 2:
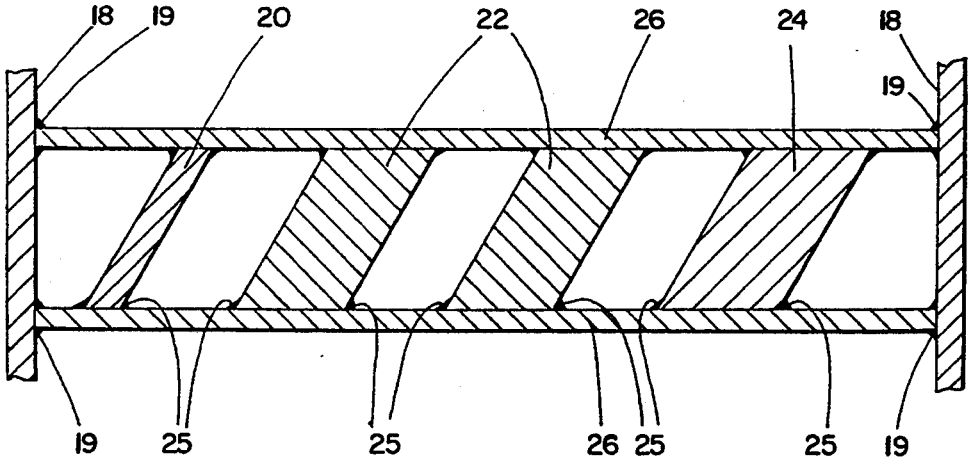
FIG. 2 is an enlarged section view of the embedded armor of the armored vehicle of FIG. 1.

Referring now to FIG. 2, the conventional frontal embedded armor arrangement 12 is composed of armor plates 20, 22, and 24 joined to an intermediate element 26 by a series of welds 25. The intermediate element 26 is rigidly fixed to a tank hull structure 18 by a series of welds 19. The armor plates 20, 22 and 24 are fixed in an inclined orientation. They range in thickness from six to twenty-four inches and are the means by which an incoming projectile 28 may be stopped to protect a crew 14, as shown in FIG. 1.

Figure 3:
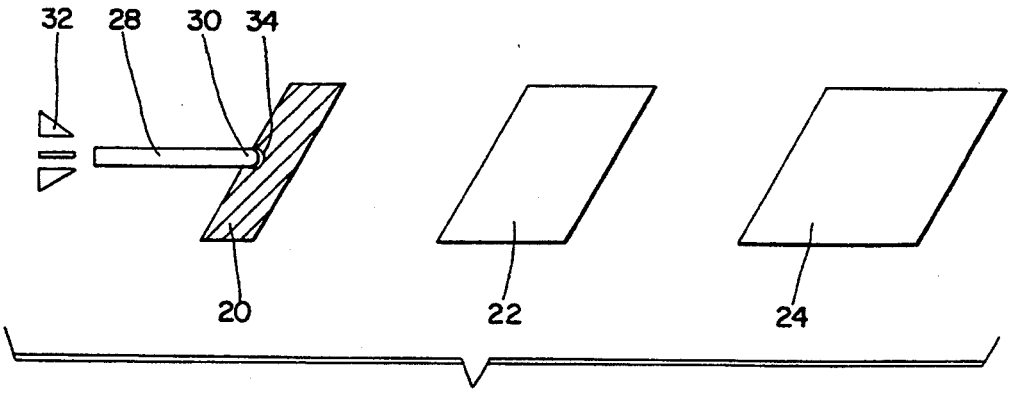
FIG. 3 is a section view of a projectile passing through the lead plate of the embedded armor of the armored vehicle of FIG. 1.
Figure 4:
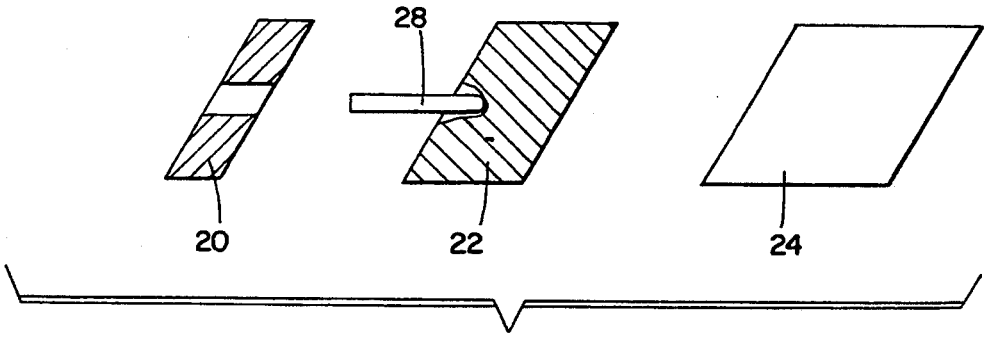
FIG. 4 is a section view of a reduced projectile passing through a secondary plate of the embedded armor of the armored vehicle of FIG. 1.
Figure 5:
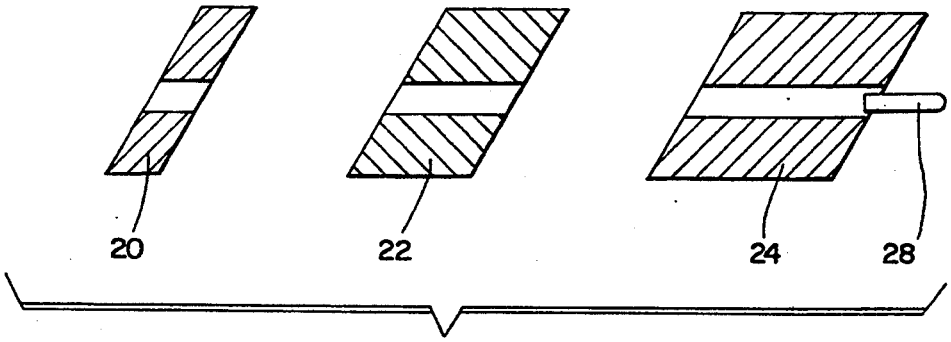
FIG. 5 is a section view of the stub of a projectile having passed through all plates of the embedded armor of the armored vehicle of FIG. 1.

Referring now to FIGS. 3 to 5 of the drawings, the progression of a high velocity projectile 28 through the series of armor plates 20, 22, 24, is illustrated. FIG. 3 shows the projectile 28 just after it has passed through the tipping screen 15 and hull 18 and as it begins entry into the first armor plate 20. Fins 32 of the projectile 28 have been sheared off and a nose 30 has been slightly deformed as it reaches this point. The projectile 28 is shown aligned on its initial trajectory and opening an initial crater 34 on a lead plate 20.

FIG. 4 shows the projectile 28 having defeated the lead plate 20, and thus proceeding through the intermediate plate 22. Still aligned on its initial trajectory, the projectile 28 craters through intermediate plate 22 while itself becoming shorter in the course of its progression.

FIG. 5 shows the remaining stub of the projectile 28 passing through the final armor plate 24, thus having defeated the spaced embedded armor system 12.

Figure 6:
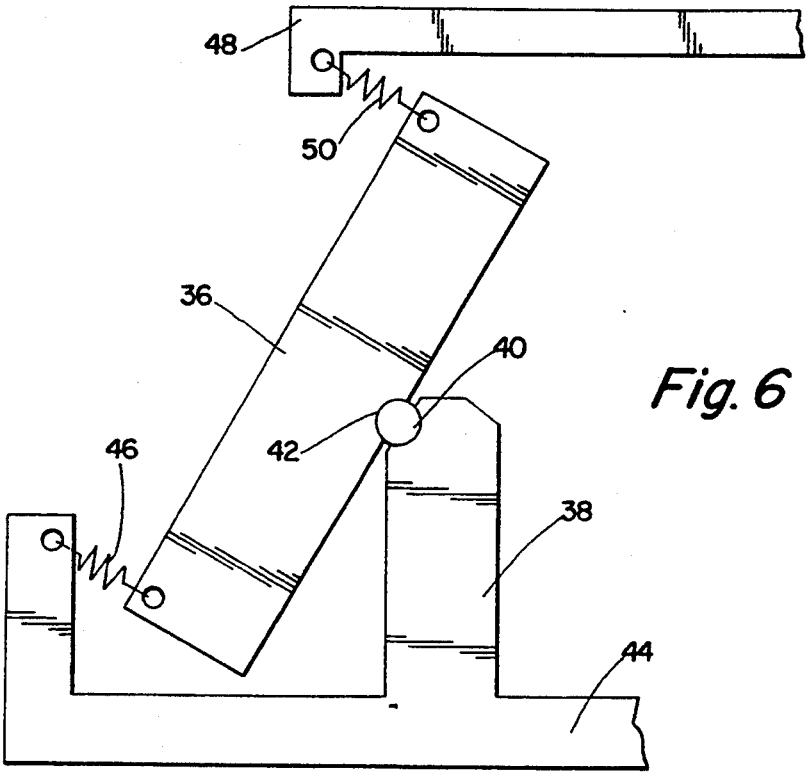
FIG. 6 is an enlarged front view of an individual plate of the embedded armor of the armored vehicle of FIG. 1 incorporating features of this invention.

FIG. 6 introduces one embodiment of the construction of this invention for a single representative armor plate 36. In this embodiment, the structure incorporates a pivot block 38 abutting the armor plate 36 through a transverse pivot 40 engaged by and contained in a recess 42 in the armor plate 36. The pivot 40 and recess 42 action may be reversed from the pivot block 38 to the plate 36. A base 44 is attached to or is an integral part of pivot block 38, and incorporates a locking step with a mechanical spring 46, thereby fixing the plate 36 into a static condition of equilibrium and allowing rotational movement only when struck off of the pivot axis by an incoming projectile 28. An upper restraint 48 also has a lock step with a mechanical spring 50 which supplements the holding of the armor plate 36 in its equilibrium standby condition but also allows for pivoting action when the plate 36 is struck by an incoming projectile 28 off of its axis of rotation.

Figure 7:
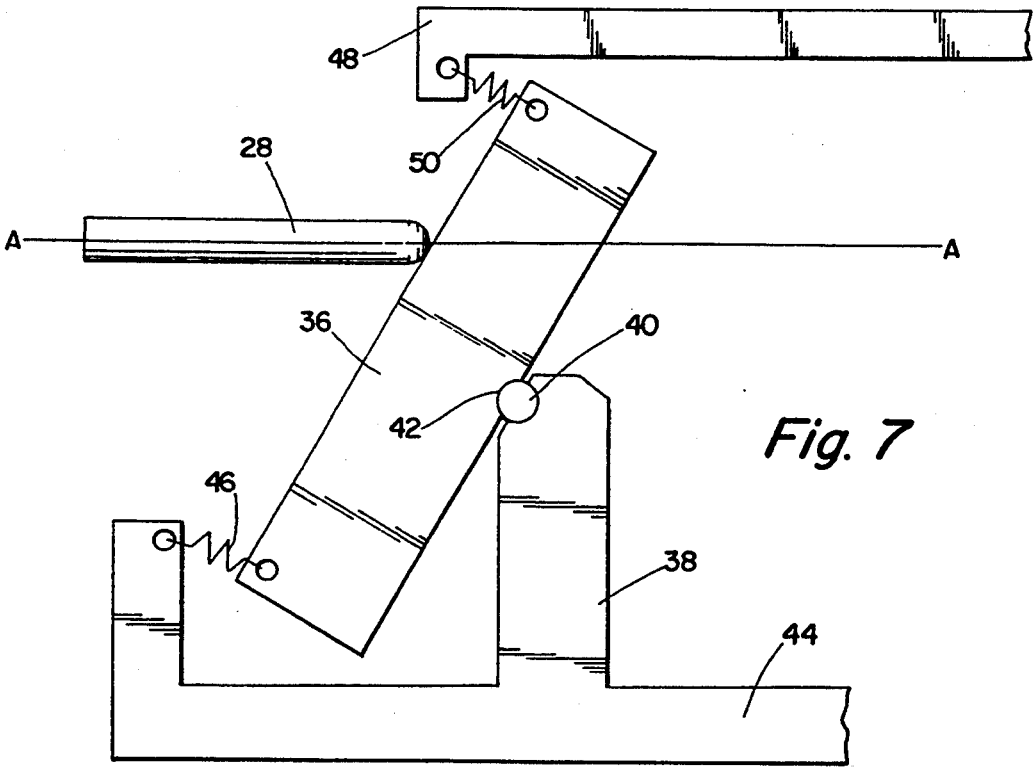
FIG. 7 is a front view of the individual plate of the embedded armor of the armored vehicle of FIG. 1 depicted in FIG. 6 with a projectile engaging the armor plate while on initial trajectory A—A.
Figure 8:
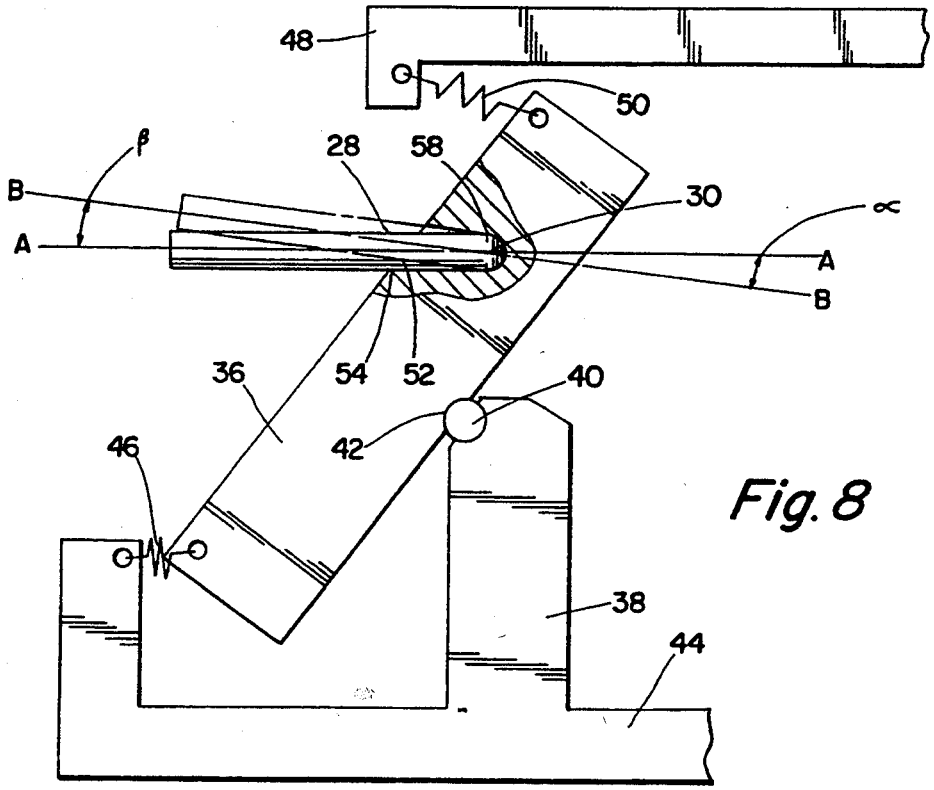
FIG. 8 is a partial section view of the individual plate of the embedded armor of the armored vehicle of FIG. 1 depicted in FIG. 6 where the projectile has rotated the pivoting armor plate and engaged on a new trajectory B—B.
Figure 9:
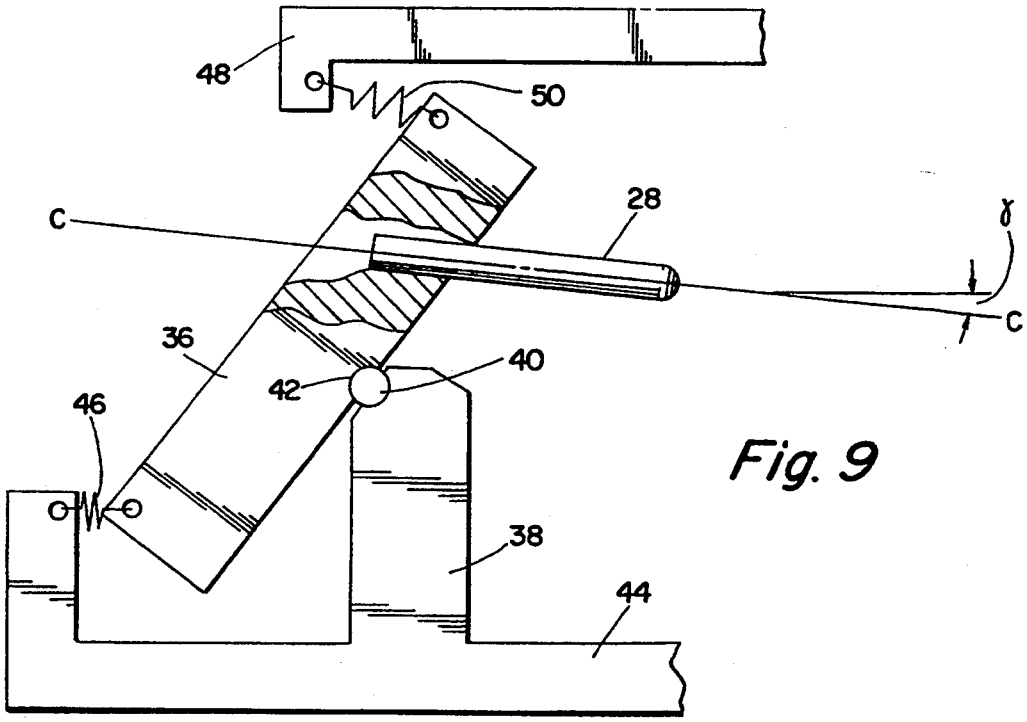
FIG. 9 is a partial section view of the individual plate of the embedded armor of the armored vehicle of FIG. 1 depicted in FIG. 6 where the projectile has exited the plate on a new trajectory C—C.

Referring now to FIGS. 7 through 9 of the drawings, the progression of a kinetic projectile 28 through the armor plate 36 of the embodiment illustrated in FIG. 6 is depicted. Referring now to FIG. 7, the projectile 28 having passed through the tipping screen 15 and tank hull 18 initially contacts the armor plate 36 while aligned on its initial trajectory A—A.

FIG. 8 shows the projectile 28 after initial penetration into the armor plate 36, the impact having rotated the plate 36 about its pivot 40 $\alpha$ degrees ($\alpha$ ranging from zero to five) as a result of the change in impulse of the intruding projectile 28. The axis of the original entry trajectory A—A is rotated $\alpha$ degrees to a new orientation B—B. Spring 46 becomes compressed while a spring 50 becomes extended. This subsequently brings the nose 30 of the projectile 28 into contract with the interior bore of the entry hole at 58 and 54, thereby rotating the projectile 28 some $\beta$ degrees from its original trajectory.

FIG. 9 shows the exit of the shortened projectile 28 from the armor plate 36 with new orientation C—C and deflection angle $\gamma$. The subsequent entry of the shortened and damped projectile 28 into further pivoting armor plates, assured by a sequential pattern of offset vertical pivoting axes, constantly adds to the deviation in original trajectory and further degrades the performance of the projectile 28.

FIGS. 10 and 11 illustrate an alternate construction including a hydraulic cylinder 60 joined to both the plate 36 and the upper restraint 48. The advantage of the hydraulic cylinder 60 is that it can provide a controlled response to the shock of the projectile 28. Action of the cylinder 60 can be controlled by changing the orifice diameter. Also, the hydraulic cylinder 60 may be thought of as a spring of huge capacity.

Figure 12B:
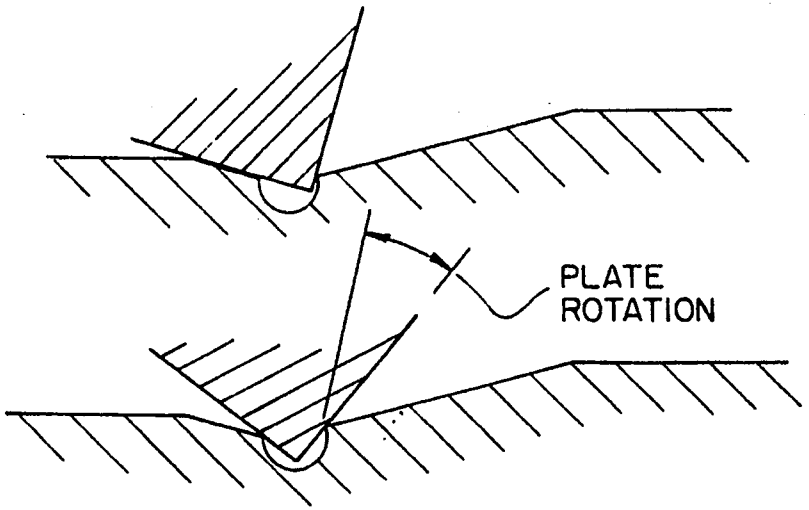
FIG. 12B is an enlarged front view of the individual plate of the embedded armor of the armored vehicle of FIG. 1 showing greater detail of the pivoting axis acting at the lower extremity of the plate.
Figure 12A:
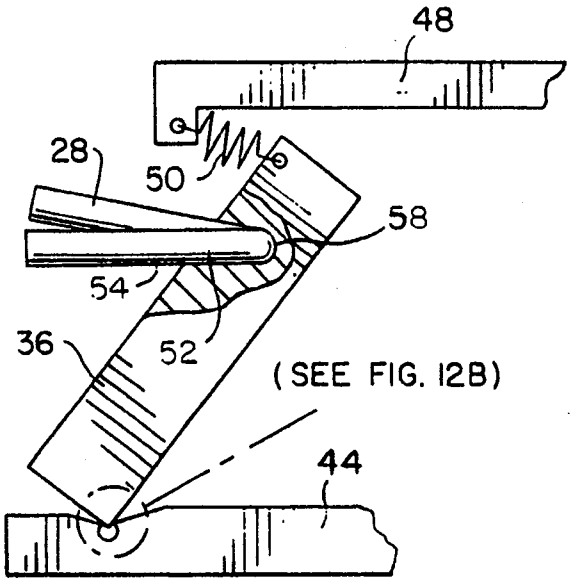
FIG. 12A is a front view of the individual plate of the embedded armor of the armored vehicle of FIG. 1 with pivoting axis acting at its lower extremity.

FIGS. 12A and 12B depict the embodiment showing a mechanical spring 50 at the upper extremity of the plate 36 and a pivoting axis acting at the lower extremity of the plate 36. By allowing the plate 36 to rest in a groove fashioned to accommodate rotation while providing restraint, the lever arm, over which the impact force of the projectile 28 acts, may be increased. Additionally, the angle at which the plate 36 and thus the projectile 28 rotate may be maximized.

Figures 13, 14, 15:
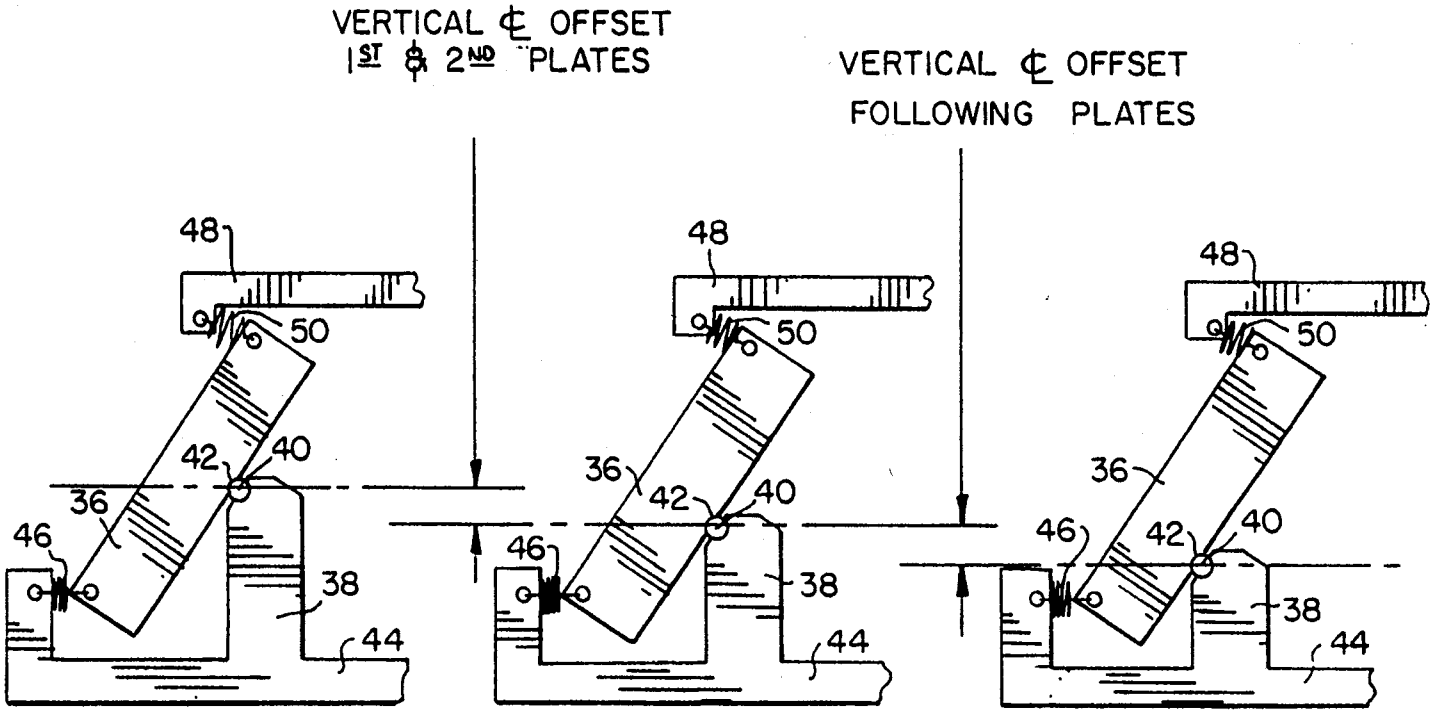
FIG. 13, FIG. 14 and FIG. 15 illustrate a horizontally sequential arrangement of the individual plate mechanisms of the embedded armor of the armored vehicle of FIG. 1 whereby the plates have vertically offset pivoting axes.

FIGS. 13–15 illustrate the concept of vertically offset pivoting axes 40 among horizontally sequential armor plates 36. Wherein the pivoting axis 40 of FIG. 14 is vertically offset with respecting to the pivoting axis of FIG. 13, and the pivoting axis of FIG. 15 is vertically offset with respect to the pivoting axis of FIG. 14. Having these axes offset by decreasing the length of the pivot block 38 insures that a projectile 28 that may be on line with one pivoting axis 40 will certainly hit off-center with another pivoting axis 40.

Figure 16:
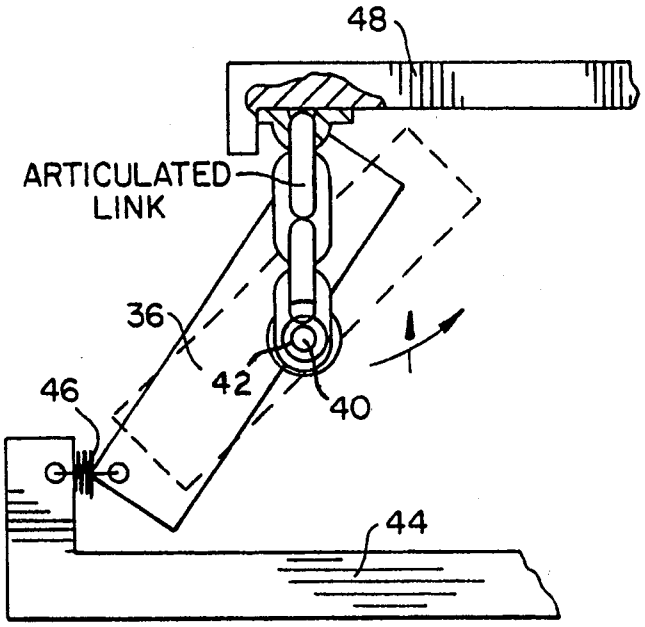
FIG. 16 is a front view of the individual plate of the embedded armor of the armored vehicle of FIG. 1 wherein the plate is being suspended by articulated links forming chains.
Figure 18:
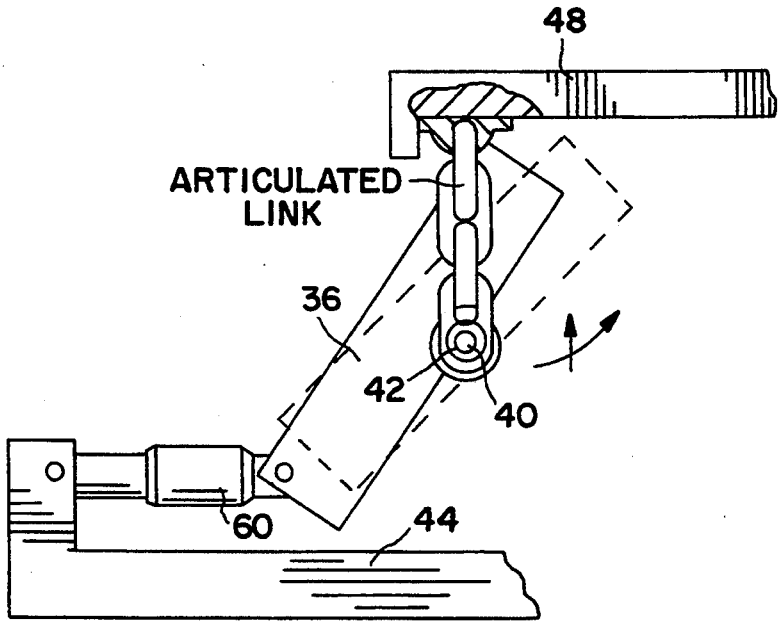
FIG. 18 is a front view of the embedded armour of the armored vehicle of FIG. 1 wherein the plate is being restrained by a hydraulic cylinder.

FIG. 16 depicts the armor plate 36 suspended by an articulated link chain. The armor plate 36, however, is free to rotate about pivot 40 when acted upon by a projectile 28. Additionally, since the pivot 40 is not connected rigidly to the hull structure 18 of the armored vehicle, the plate 36 actually translates upward upon being struck by a projectile 28, as shown by the dashed lines. In this manner, some of the kinetic energy of the incoming projectile 28 is translated into the potential energy required to raise the plate 36. The plate 36 is also connected at the lower extremity by a mechanical spring 46 to the base 44 or a hydraulic cylinder 60 as seen in FIG. 18.

Figure 17:
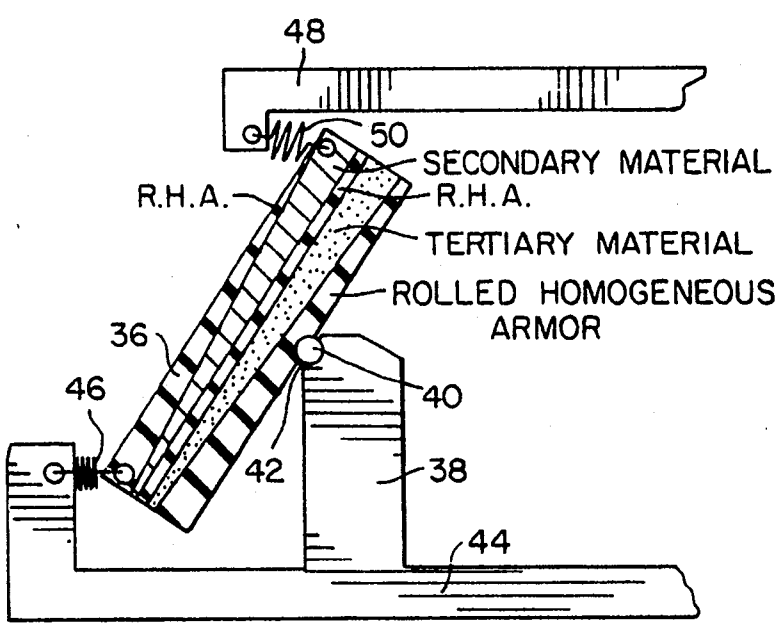
FIG. 17 is a front view of the individual plate of the embedded armor of the armored vehicle of FIG. 1 illustrating a sandwich armor construction.

FIG. 17 illustrates a sandwich type of construction for the armor plate 36. Having layers of materials with different densities and other characteristics make up the plate 36 aids in deflecting and retarding the shock wave imposed upon the armored vehicle 10 by an incoming projectile 28. Additionally, the internal collapse of the elements within the plate 36 magnifies the turning action of the projectile 28.

These teachings may apply to embedded armor arrangements found throughout other positions in a tank, as well as to other similar armor systems which may exist in various military vehicles, ships, aircraft, and manned centers of operation in danger of strike by a kinetic round.

Obviously, there are a variety of modifications and variations which may be applied to the invention without altering the spirit of the fundamental concept herein involved. It is, therefore, to be understood that within the scope of the appended claims, the invention may be practiced otherwise than as specifically described.

What is claimed is:

1. An improved embedded armor apparatus for protecting armored vehicles against incoming kinetic energy projectiles, comprising:

an armored vehicle having a rigid hull structure;

a series of horizontally sequential armor plates of inclined orientation resiliently mounted in said armored vehicle to said rigid hull structure of said armored vehicle;

a plurality of horizontally oriented transverse axles inflexibly joined to said rigid hull structure of said armored vehicle, rigidly restrained against translation, and each associated with a separate one of said series of horizontally sequential armor plates about which said series of horizontally sequential armor plates may mechanically pivot, wherein said series of horizontally sequential armor plates may not translate due to attachment to said horizontally oriented transverse axles; and, an elastic mechanical restraint means for securedly connecting an extremity of said series of horizontally sequential armor plates to said rigid hull structure of said armored vehicle, whereby said series of horizontally sequential armor plates may pivot about said horizontally oriented transverse axles when acted upon by an outside force.

2. An improved embedded armor apparatus for protecting armored vehicles against incoming kinetic energy projectiles as recited in claim 1, wherein said elastic mechanical restraint means further comprises a mechanical spring.

3. An improved embedded armor apparatus for protecting armored vehicles against incoming kinetic energy projectiles as recited in claim 1, wherein said elastic mechanical restraint means further comprises a mechanical coil spring.

4. An improved embedded armor apparatus for protecting armored vehicles against incoming kinetic energy projectiles, as recited in claim 1, wherein said elastic mechanical restraints further comprises a hydraulic cylinder.

5. An improved embedded armor apparatus for protecting armored vehicles against incoming kinetic energy projectiles as recited in claim 1, wherein said elastic restraint means is arranged at an upper extremity of said series of horizontally sequential armor plates, and wherein said horizontally oriented transverse axle is arranged at a lower extremity of said series of horizontally sequential armor plates.

6. An improved embedded armor apparatus for protecting armored vehicles against incoming kinetic energy projectiles as recited in claim 1, wherein said series of horizontally sequential armor plates has vertically offset pivoting axes.

7. An improved embedded armor apparatus for protecting armored vehicles against incoming kinetic energy projectiles, as recited in claim 1, wherein said series of horizontally sequential armour plates is formed of a sandwich construction incorporating alternate layers of collapsible material.

8. An improved embedded armor apparatus for protecting armored vehicles against incoming kinetic energy projectiles, comprising:

an armored vehicle having a rigid hull structure including;

a plurality of chains formed by articulated links which are inflexibly joined to said rigid hull structure;

a series of horizontally sequential armor plates of inclined orientation resiliently suspended in said armored vehicle from said rigid hull structure of said armored vehicle by said chains;

an elastic mechanical restraint means for acting at a lower extremity of said series of horizontally sequential armor plates, and;

a plurality of horizontally oriented transverse axles each associated with a separate one of said series of horizontally sequential armor plates and about which said chains allow said series of horizontally sequential armor plates to mechanically pivot, wherein said horizontally oriented transverse axles are flexibly joined to said rigid hull structure by said chains, and said chains allow said series of horizontally sequential armor plates to translate upwards when acted upon by an outside force.

9. An improved embedded armor apparatus for protecting armored vehicles against incoming kinetic energy projectiles, as recited in claim 8, wherein said elastic restraint means further comprises a mechanical spring.

10. An improved embedded armor apparatus for protecting armored vehicles against incoming kinetic energy projectiles, as recited in claim 8, wherein said elastic restraint means further comprises a mechanical coil spring.

11. An improved embedded armor apparatus for protecting armored vehicles against incoming kinetic energy projectiles, as recited in claim 8, wherein said elastic restraint means further comprises a hydraulic cylinder.

* * * * *